US005832626A

United States Patent [19]

Buttschardt

[11] Patent Number: 5,832,626

[45] Date of Patent: Nov. 10, 1998

[54] SINGLE FELT DRYER GROUP

[75] Inventor: Werner Buttschardt, Herbrechringen, Germany

[73] Assignee: Voith Sulzer Papiermaschinen GmbH, Heidenheim, Germany

[21] Appl. No.: 843,344

[22] Filed: Apr. 15, 1997

[30] Foreign Application Priority Data

| | | | |
|---|---|---|---|
| Apr. 19, 1996 | [DE] | Germany | 296 07 077.7 |
| Dec. 7, 1996 | [DE] | Germany | 196 50 890.8 |

[51] Int. Cl.[6] ..... F26B 11/02; D06F 58/00

[52] U.S. Cl. ..... 34/117; 34/116

[58] Field of Search ..... 34/116, 117, 120, 34/123, 458

[56] References Cited

U.S. PATENT DOCUMENTS

| | | | |
|---|---|---|---|
| 3,529,755 | 9/1970 | Spangenberg et al. | 225/4 |
| 4,918,836 | 4/1990 | Wedel | 34/117 |
| 4,945,655 | 8/1990 | Wedel | 34/117 |
| 5,105,561 | 4/1992 | Wulz | 34/117 |
| 5,185,063 | 2/1993 | Aula et al. | 162/193 |
| 5,248,390 | 9/1993 | Fissmann et al. | 162/193 |
| 5,505,006 | 4/1996 | Wulz et al. | 34/117 |
| 5,639,350 | 6/1997 | Aula et al. | 162/193 |
| 5,673,495 | 10/1997 | Jilek et al. | 34/458 |

FOREIGN PATENT DOCUMENTS

| | | |
|---|---|---|
| 398320 | 3/1994 | Austria . |
| 3605085 | 8/1987 | Germany . |
| 9103749 | 8/1991 | Germany . |
| 9206341 | 9/1992 | Germany . |
| 29510637 | 11/1995 | Germany . |
| 4428745 | 2/1996 | Germany . |

OTHER PUBLICATIONS

Randolph, Wasserstrahl und Ultraschall als Medien beim formgerechten Scneiden von textilien, Melliand Textilberichte, Dec. 1992, pp. 948 and 949.

Technische Textilien Mit Wasser Geschnitten, Chemiefasern//Textilindustrie, 40./92. Jg, Mar. 1990, T36–T38.

*Primary Examiner*—William Doerrler

*Attorney, Agent, or Firm*—Greenblum & Bernstein, P.L.C.

[57] ABSTRACT

The invention relates to dryer assembly including a taper cutter device, which is disposed adjacent to and after a top felt dryer group of a paper making machine. The taper cutter may be arranged between a last dryer cylinder of the top felt dryer group and a subsequent web guide roll. Further, the taper cutter may be positioned to contact the material web after a transport belt has separated from the material web and before the material web is lifted off a last dryer cylinder surface. At least the final dryer cylinder and the subsequent web guide roll can be driven.

14 Claims, 1 Drawing Sheet

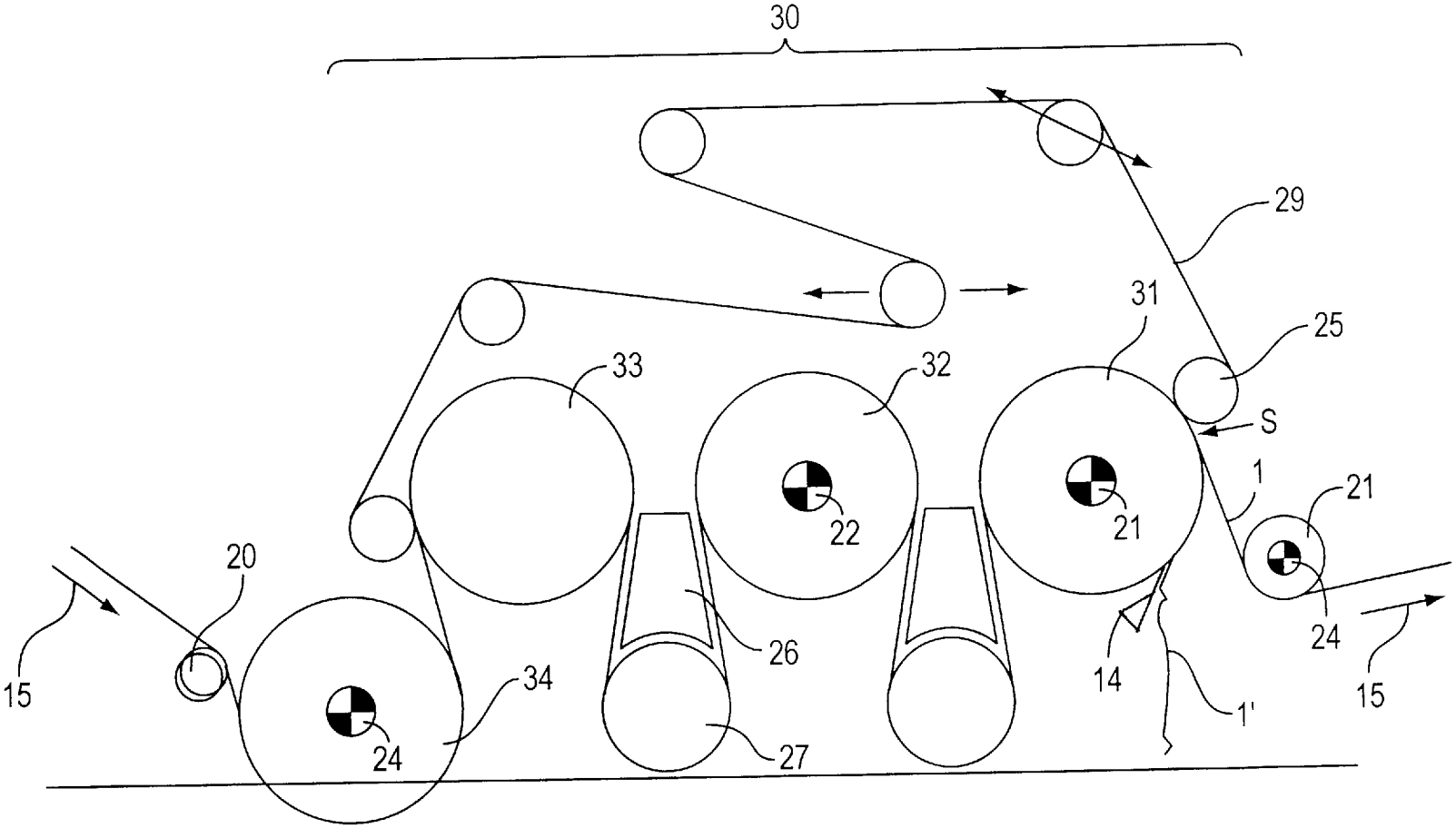
30
29
25
S
1
21
24
15
31
21
14
1'
32
22
26
27
33
34
24
20
15

SINGLE FELT DRYER GROUP

CROSS-REFERENCE OF RELATED APPLICATION

The present invention claims the priority under 35 U.S.C. §119 of German Patent Application No. 296 07 077.7 filed on Apr. 19, 1996 and German Patent Application No. 196 50 890.8 filed on Dec. 7, 1996.

BACKGROUND OF THE INVENTION

1. Field of the Invention

The present invention relates to a machine including a single-felt dryer group having at least two heatable dryer cylinders that guide a fibrous web, e.g., paper or cardboard, to be dried and that contact only one side of the fibrous web and an endless support belt traveling with the fibrous web over an upper region of respective jacket faces of the dryer cylinders. The machine may further include a taper cutter, positioned after the single-felt dryer group and between a last drivable cylinder and a subsequent web guide roll.

2. Discussion of Background Information

Single-felt dryer groups generally related to the above-noted system have been discussed in German Utility Model DE 295 10 637.9. A so-called "taper cutter" is required between and/or preceding the prior art single-felt dryer groups, and is used for removing an edge strip from a traveling fibrous web, e.g., paper or cardboard. When a fibrous web is threaded, the edge strip is first introduced alone into the subsequent subassembly. Only after successful threading of the fibrous web is the taper cutter laterally moved to a travel direction of the web so that the originally narrow edge strip gradually assumes a full width of the fibrous web.

In the above-noted document, the taper cutter is located between a web guide roll and a subsequent single-felt dryer group and cuts the fibrous web in a so-called "open draw." Thus, the fibrous web is not in contact with either a roll body or a support belt when acted upon by the taper cutter. This arrangement has the disadvantages that there must always be an open draw and, that, because there is no support available for the fibrous web, the fibrous web is often unfavorably guided, which can lead to problems in web stability.

A particular problem that also arises is that when the taper cutter acts upon the fibrous web, the fibrous web is not yet sufficiently dry and, therefore, lacks the strength to withstand the taper cutter.

SUMMARY OF THE INVENTION

An object of the present invention, therefore, is to provide an arrangement for use with a single-felt dryer group that permits reliable cutting of an edge strip.

The object may be achieved by positioning a taper cutter after the single-felt dryer group and between a last drivable cylinder and a subsequent drivable web guide roll. Thus, the taper cutter may be positioned at an end of the single-felt dryer group. Because of this arrangement, the fibrous web may first undergo additional drying and also experiences an additional increase in strength.

In accordance with the present invention, at least a last dryer cylinder of the single-felt dryer group may be driven. The non-driven cylinders may be pulled along with the driven cylinders by the support or transport belt. It is noted that, if other cylinders were also driven, a slip-induced circumference speed differential in the direction of the last cylinder would be produced. This differential could only be estimated in an unreliable manner. Accordingly, an actual web speed, after the last cylinder, cannot be precisely defined.

If a web guide roll located after the last cylinder is also driven, then an arrangement of a specific draw with the fibrous web may be possible with the assistance of defined circumference speeds of the cylinder and the web guide roll.

The above-noted position of the taper cutter cannot be further optimized. That is, when viewed in terms of a web travel direction, the support belt may be lifted from a surface of the last cylinder, and, only after this action, may the fibrous web be lifted up from the last cylinder. In this way, the fibrous web may also be supported by a cylinder jacket face while the taper cutter acts on the fibrous web. If cutting takes place in this region of the dryer section, then the fibrous web inadvertently move out of the way of the cutting pressure. Thus, a controllable cutting of the edge strip may be achieved. In a preferred exemplary embodiment of the present invention, the cutting device may be a water jet taper cutter so as not to damage the cylinder surface.

Accordingly, the present invention may be directed to a dryer assembly. The dryer assembly may include a single-felt dryer group including at least two dryer cylinders for guiding a fibrous web to be dried. The at least two dryer cylinders may contact an underside of the fibrous web and an endless support belt may guide the fibrous web over an upper portion of the at least two dryer cylinders. A taper cutter may be positioned at an end of the single-felt dryer group and located between a last drivable cylinder of the single-felt dryer group and a subsequent drivable web guide roll.

According to another feature of the present invention, the taper cutter may cut the fibrous web in a region in which the fibrous web is on the last drivable cylinder and is not touched by the support belt.

According to another feature of the present invention, 1, the taper cutter may include a water jet taper cutter.

According to still another feature of the present invention, at least the last cylinder may be driven.

According to a further feature of the present invention, the subsequent web guide roll may be driven.

According to yet another feature of the present invention, a draw for the fibrous web may be adjustable between the last drivable cylinder and the subsequent web guide roll by a circumferential speed differential between the last drivable cylinder and the web guide roll.

The present invention may be directed to a dryer assembly in a material web producing machine. The dryer assembly may include a dryer group including a plurality of dryer cylinders having at least one drivable dryer cylinder, a subsequent web guide roll for guiding the material web exiting the dryer group, and a taper cutter positioned between the dryer group and the subsequent web guide roll.

According to another feature of the present invention, the dryer group may further include a transport belt for guiding the material web in a meandering path around at least a portion of each of the plurality of dryer cylinders and at least one deflection roll for deflecting the transport belt from a last dryer cylinder to a beginning of the dryer group.

According to another feature of the present invention, the taper cutter may be positioned adjacent an end of the dryer group at a position after the transport belt has been deflected.

According to a further feature of the present invention, the subsequent web guide roll may include a drivable web guide roll.

According to still another feature of the present invention, the taper cutter may include a water jet taper cutter.

According to a still further feature of the present invention, the at least one drivable dryer cylinder may include a last dryer cylinder of the dryer group.

According to another feature of the present invention, a speed of the subsequent web guide roll may be selected in accordance with a speed of the at least one drivable dryer cylinder dryer to provide a specific draw with the fibrous web.

According to still another feature of the present invention, the at least one drivable dryer cylinder may include a last dryer cylinder of the dryer group.

According to yet another feature of the present invention, the taper cutter may be positioned adjacent to a point at which the fibrous web contacts a last dryer cylinder.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting examples of preferred embodiments of the present invention, and wherein:

The FIGURE illustrates an arrangement for a dryer section including a taper cutter device.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the invention may be embodied in practice.

A fibrous (material) web 1, e.g., output from a web treatment device, e.g. a coating station or size press, may travel around a spreader roll 20 and around a portion of a dryer cylinder 34 before being introduced to a single-felt (e.g., top-felt) dryer group 30. Single-felt dryer group 30 may include a plurality of dryer cylinders 33, 32, and 31 and a plurality of web guide rolls 27 and a transport belt (dryer screen) 29 which winds around at least a portion of each of the dryer cylinders and web guide rolls. Single-felt dryer group 30 may also include a plurality of guide rolls to return the transport belt from an end of dryer group 30 to a beginning of dryer group 30. Because transport belt 29 does not wind around dryer cylinder 34, dryer cylinder 34 may include a separate drive mechanism 24. When fibrous web 1 travels from dryer cylinder 24 to single-felt dryer group 30, fibrous web 1 may be guided through single-felt dryer group 30 along a meandering or winding path by transport belt 29. In a web travel direction 15, fibrous web 1 may wind around and contact, in succession, portions of dryer cylinders 33, 32, and 31. The portions of the dryer cylinders contacted by fibrous web 1 may be on an upper region of each respective roll jacket surface of the dryer cylinders. Deflection rolls 27, with associated web stabilizers 26, may be disposed between cylinders 33 and 32, and between cylinders 32 and 31. Deflection rolls 27 may be, e.g., suction rolls and may be, e.g., perforated, grooved, or perforated and grooved. Suction rolls 27 and pockets formed between dryer cylinders 33, 32, 31 and the suction rolls 27 may be aspirated by the web stabilizer 26.

At the end of single-felt dryer group 30, support belt 29 may be deflected from dryer cylinder 31 by guide roll 25 to uncover the upper side of fibrous web 1 while the lower side continues to contact the outer surface of dryer cylinder 31. A subsequent web guide roll 21 may be optionally provided outside single-felt dryer group 30 with a separate drive 24 to receive fibrous web 1. In this arrangement, a draw may be precisely constructed in fibrous web 1 between dryer cylinder 31 and web guide roll 21. Thus, in this region, where fibrous web 1 still rests on dryer cylinder 31, fibrous web 1 may be similarly supported in a particularly favorable manner. At this location, a taper cutter S, e.g., a water jet taper cutter, may be positioned, as shown by the arrow.

If fibrous web 1 has been threaded into single-felt dryer group 30, then fibrous web 1 may run off dryer cylinder 21, e.g., traveling downward into a scrap pulper (not shown) as scrap web 1'. To prevent scrap web 1 ' from sticking to dryer cylinder 21, a scraper 14 may be abuttingly positioned adjacent the outer surface of dryer cylinder 21. At an edge spacing of, e.g., approximately 200 to 500 mm, taper cutter S may divide fibrous web 1 into two individual strips. The present invention may then utilize at least one blower element (not shown) to deflect a narrower web strip, e.g., a small belt, around web guide roll 21 to be guided or forwarded to other downstream elements of the paper making machine. Drivable cylinder 31 and web guide roll 21, which may likewise be driven, may now permit a definite tension to be built up in the fibrous web 1, thus, stabilizing the separation process. After a successful transfer of fibrous web 1 to the downstream elements of the paper making machine, the taper cutter may be laterally moved with respect to the web travel direction so that the small belt may become wider. Once the small belt has reached full width of fibrous web 1, then the transfer of fibrous web 1 may be considered concluded and taper cutter S may be switched off.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A dryer assembly comprising:

a single-felt dryer group including at least two dryer cylinders for guiding a fibrous web to be dried;

the at least two dryer cylinders contacting an underside of the fibrous web;

an endless support belt that guides the fibrous web over an upper portion of the at least two dryer cylinders;

a taper cutter positioned at an end of the single-felt dryer group and located between a last drivable cylinder of the single-felt dryer group and a subsequent drivable web guide roll; and at least the last drivable cylinder of the single-felt dryer group being driven.

2. The dryer assembly according to claim 1, the taper cutter for cutting the fibrous web in a region in which the fibrous web is on the last drivable cylinder and is not touched by the support belt.

3. The dryer assembly according to claim 1, the taper cutter comprising a water jet taper cutter.

4. The dryer assembly according to claim 1, the subsequent web guide roll is driven.

5. The dryer assembly according to claim 1, a draw for the fibrous web is adjustable between the last drivable cylinder and the subsequent web guide roll by a circumferential speed differential between the last drivable cylinder and the web guide roll.

6. The dryer assembly according to claim 1, the at least two dryer cylinders contacting only the underside of the fibrous web.

7. A dryer assembly in a material web producing machine comprising:

a dryer group comprising a plurality of dryer cylinders including at least one drivable dryer cylinder, the at least one drivable dryer cylinder including a last dryer cylinder of the dryer group;

a subsequent web guide roll for guiding the material web exiting the dryer group; and a taper cutter positioned between the dryer group and the subsequent web guide roll.

8. The dryer assembly according to claim 7, further comprising a transport belt for guiding the material web in a meandering path around at least a portion of each of the plurality of dryer cylinders; and at least one deflection roll for deflecting the transport belt from a last dryer cylinder to a beginning of the dryer group.

9. The dryer assembly according to claim 8, the taper cutter positioned adjacent an end of the dryer group at a position after the transport belt has been deflected.

10. The dryer assembly according to claim 7, the subsequent web guide roll comprising a drivable web guide roll.

11. The dryer assembly according to claim 10, the taper cutter comprising a water jet taper cutter.

12. The dryer assembly according to claim 7, a speed of the subsequent web guide roll selected in accordance with a speed of the at least one drivable dryer cylinder dryer to provide a specific draw with the fibrous web.

13. The dryer assembly according to claim 7, the at least one drivable dryer cylinder comprising a last dryer cylinder of the dryer group.

14. The dryer assembly according to claim 7, the taper cutter to be positioned adjacent to a point at which the fibrous web contacts a last dryer cylinder.

* * * * *

UNITED STATES PATENT AND TRADEMARK OFFICE

CERTIFICATE OF CORRRECTION

PATENT NO. : 5,832,626 
DATED : November 10, 1998
INVENTOR(S) : Buttschardt It is certified that error appears in the above-identified patent and that said Letters Patent is hereby corrected as shown below:

On the title page, under item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 9 | 3 | 4 | 0 | 6 | 7 | 06/19/90 | WEDEL | | | |
| | | 5 | 4 | 0 | 4 | 6 | 5 | 3 | 04/11/95 | SKAUGEN et al. | | | |
| | | 5 | 5 | 0 | 7 | 1 | 0 | 4 | 04/16/96 | SKAUGEN et al. | | | |
| | | 4 | 8 | 0 | 7 | 3 | 7 | 1 | 02/28/89 | WEDEL | | | |
| | | 4 | 8 | 7 | 6 | 8 | 0 | 3 | 10/31/89 | WEDEL | | | |
| | | | | | | | | | | | | | |

UNITED STATES PATENT AND TRADEMARK OFFICE

CERTIFICATE OF CORRRECTION

PATENT NO. : 5,832,626 
DATED : November 10, 1998
INVENTOR(S) : Buttschardt It is certified that error appears in the above-identified patent and that said Letters Patent is hereby corrected as shown below:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 9 | 8 | 0 | 9 | 7 | 9 | 01/01/91 | WEDEL | | | |
| | | 4 | 9 | 0 | 5 | 3 | 7 | 9 | 03/06/90 | WEDEL | | | |
| | | 4 | 9 | 7 | 0 | 8 | 0 | 5 | 11/20/90 | WEDEL | | | |
| | | 5 | 6 | 2 | 8 | 1 | 2 | 4 | 05/13/97 | SKAUGEN et al. | | | |
| | | 5 | 1 | 7 | 5 | 9 | 4 | 5 | 01/05/93 | SKAUGEN et al. | | | |
| | | | | | | | | | | | | | |

UNITED STATES PATENT AND TRADEMARK OFFICE

CERTIFICATE OF CORRRECTION

PATENT NO. : 5,832,626 
DATED : November 10, 1998
INVENTOR(S) : Buttschardt It is certified that error appears in the above-identified patent and that said Letters Patent is hereby corrected as shown below:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 9 | 1 | 0 | 1 | 2 | 4 | 8 | 07/04/91 | Germany | | | | |
| | | | | | | | | | | | | | | |

Signed and Sealed this

Twenty-third Day of March, 1999

*Attest:*

Q. TODD DICKINSON

*Attesting Officer*

*Acting Commissioner of Patents and Trademarks*